US007173527B2

(12) United States Patent
Wilson et al.

(10) Patent No.: US 7,173,527 B2
(45) Date of Patent: Feb. 6, 2007

(54) PULL-APART CONTACT USING MAGNETS TO COMPLETE THE CIRCUIT

(75) Inventors: George N. Wilson, Maspeth, NY (US); Kevin G. Piel, Ronkonkoma, NY (US); Thomas S. Babich, Glen Cove, NY (US); Robert E. Lee, Garden City, NY (US)

(73) Assignee: Honeywell International, Inc., Morristown, NJ (US)

( * ) Notice: Subject to any disclaimer, the term of this patent is extended or adjusted under 35 U.S.C. 154(b) by 119 days.

(21) Appl. No.: 10/989,793

(22) Filed: Nov. 16, 2004

(65) Prior Publication Data

US 2006/0103526 A1 May 18, 2006

(51) Int. Cl.
*G08B 13/08* (2006.01)

(52) U.S. Cl. ..... 340/547; 307/112; 200/404

(58) Field of Classification Search ..... 340/547; 307/112–144

See application file for complete search history.

(56) References Cited

U.S. PATENT DOCUMENTS 3,636,484 A * 1/1972 Lea ..... 335/205
6,774,807 B1 * 8/2004 Lehfeldt et al. ..... 340/686.1
7,038,310 B1 * 5/2006 Nakatani et al. ..... 257/706

* cited by examiner

*Primary Examiner*—Jeffery Hofsass
*Assistant Examiner*—Hongmin Fan
(74) *Attorney, Agent, or Firm*—Scully, Scott, Murphy & Presser, P.C.

(57) ABSTRACT

An apparatus and method are provided for a security device for residential and/or commercial use. A first magnetic member has a first magnet with a north and south pole, and a second magnetic member has a second magnet with a south and north pole. Contact between the north pole of the first magnet and south pole of the second magnet, or vice versa, completes an electrical circuit by conducting electricity between the first and second magnets, and a magnetic force between the first and second magnets holds the first and second magnets in contact. The electrical circuit is broken when a force sufficient to overcome the magnetic force is applied to separate the first and second magnets. When contact between the first magnet and second magnet is broken off, such as by opening a door or window, the electrical circuit is broken, and an alarm is triggered.

26 Claims, 3 Drawing Sheets

PULL-APART CONTACT USING MAGNETS TO COMPLETE THE CIRCUIT

BACKGROUND OF THE INVENTION

1. Field of the Invention

The present invention relates to security systems for residential and commercial structures, and more specifically, to burglar alarm devices for closures such as windows, doors, and the like. Specifically, the present invention relates to an improved burglar alarm using magnets to close a circuit between pull-a-part contacts for use with movable closures.

2. Prior Art

Security systems for homes and offices are quite varied and diverse and range from extremely sophisticated and expensive electronic systems to simple locking mechanisms and the like. The degree of security provided by any particular device or system is somewhat related to the sophistication and expense of the system. For many residential uses, a complete security system for doors, windows and other entry points is frequently cost-prohibitive for the average consumer. However, the number of residential burglaries has continuously increased over the years leading to a greater consumer need and demand for such systems. Thus, there is a need for simplified burglar alarms or security systems that are easy to use and inexpensive to manufacture and purchase.

Bar or stick alarms for closures having movable members, such as sliding doors and windows, are well known in the art. Examples of such devices are illustrated in U.S. Pat. Nos. 3,797,005, 4,193,067, 4,472,709, 4,495,486 and 4,553,134. Devices such as those illustrated in these prior art references, include bars or rods that are placed between a stationary window jamb or door frame and an edge of the slidable, moving member. When the movable member of the closure is then opened, a plunger or similar type of mechanism projecting from the rod is struck by the movable member and closes an electrical circuit, thereby activating an alarm.

While such devices are relatively effective and simple to install, there are several disadvantages with the systems disclosed in these references. One such disadvantage is that a burglar or intruder can break the closure glass and simply detach the burglar alarm stick without activating it. Once the stick has been detached from the movable member, the intruder can pry the movable closure member open and gain entry to the residence or office. Hence, there is no alarm mode for unauthorized or inadvertent removal of the alarm stick from its position against the closure. Further, these devices are large and easily seen or noticed by the burglar well before breaking in, so that the burglar would know to break the glass and detach the burglar alarm stick before activation. In addition, the devices as disclosed in these references include rather sophisticated plunger circuitry as well as some complex alarm mechanisms. Thus, there remains a distinct need in the home security field for a simplified burglar alarm for residences and offices that are small, unnoticeable, simple in design and use, and inexpensive.

SUMMARY OF THE INVENTION

Therefore, it is an object of the present invention to provide an alarm device and security system for use with closures such as windows, doors, sliding doors and the like, which device is simple in construction and inexpensive to manufacture, and that uses an inconspicuous system and method for residential and commercial use.

It is another object of the present invention to provide an alarm device for use with closures such as windows, doors, sliding doors and the like, wherein the device may be activated by either unauthorized opening of the closure or by unauthorized removal of the device from its position relative to the closure.

To achieve the foregoing and other objects and in accordance with the purpose of the present invention, as embodied and broadly described herein, a security or alarm device for residential and/or commercial use for closures such as windows, doors, sliding doors, and the like is disclosed.

The security device for residential and/or commercial use comprises a first magnetic member having a first magnet with a north pole at a proximal end of the first magnetic member and a south pole at a distal end of the first magnetic member, and a second magnetic member having a second magnet with a south pole at a proximal end of the second magnetic member and a north pole at a distal end of the second magnetic member, wherein contact between the first magnet and second magnet at the proximal ends of the first and second magnetic members completes an electrical circuit, wherein a magnetic force between the first and second magnets holds the first and second magnets in contact, and the electrical circuit is broken when a force sufficient to overcome the magnetic force is applied to separate the first and second magnets. When the electrical circuit is broken, an alarm is triggered.

The first magnetic member is placed on a movable portion of a closure structure and the second magnetic member is placed on a stationary portion of the closure structure. The movable portion can be a door or window, and the stationary portion can be a door frame, window frame, wall, floor or ceiling.

The first magnetic member can further comprise a third magnet with a north pole at the proximal end of the first magnetic member and a south pole at the distal end of the first magnetic member, and the second magnetic member can further comprise a fourth magnet with a south pole at the proximal end of the second magnetic member and a north pole at the distal end of the second magnetic member.

The security device further comprises electrical connections from the first magnet to terminals located on the first magnetic member, and electrical connections from the second magnet to terminals located on the second magnetic member. The electrical connections can comprise wires or springs.

Further, wires run from the terminals of the first magnetic member back to an alarm system. Wires can run from the terminals of the second magnetic member to an end of line resistor to end an alarm loop, or to terminals of a third magnetic member similar to the first magnetic member, thus extending the alarm loop. The first and second magnetic members are made of plastic with recesses and the first and second magnets are situated inside these recesses.

The security device further comprises end caps provided at the distal ends of the first and second magnetic members. The magnets can be made of a magnetic material selected from a group consisting of Aluminum Nickel Cobalt, Neodymium Boron Iron, Samarium Cobalt and Ceramic. The first and second magnets can be coated with a plating material such as Tin, Nickel or Gold to prevent oxidation. A contact surface between the first and second magnets can be a flat surface, a cylindrical radius or a spherical radius.

Also provided is a method of installing a residential and/or commercial security device, the method comprising attaching a first magnetic member having a first magnet with a north pole at a proximal end of the first magnetic member and a south pole at a distal end of the first magnetic member, with a second magnetic member having a second magnet with a south pole at a proximal end of the second magnetic member and a north pole at a distal end of the second magnetic member, completing an electrical circuit by making contact between the first magnet and the second magnet, and holding the first and second magnets in contact with each other by a magnetic force between the first and second magnets.

The method further comprises further comprising disconnecting the electrical circuit by separating the first and second magnets by applying a force sufficient to overcome the magnetic force, and triggering an alarm when the electrical circuit is disconnected.

The method further comprises forming an alarm loop by running an electrical connection from the first magnet to terminals on the first magnetic member, and through wires from the terminals to an alarm panel. An electrical connection can be run from the second magnet to terminals on the second magnetic member, and through wires on the terminals to an end of line resistor to end the alarm loop. Alternatively, an electrical connection can be run from the second magnet to terminals on the second magnetic member, and from terminals on the second magnetic member to terminals of a third magnetic member similar to the first magnetic member, extending the alarm loop.

The method further comprises placing the first magnetic member on a movable portion of a closure structure and placing the second magnetic member on a stationary portion of the closure structure. The method further comprises providing end caps at the distal ends of the first and second magnetic members. Magnets made of Aluminum Nickel Cobalt, Neodymium Boron Iron, Samarium Cobalt or Ceramic can be used as the first and second magnets. The method further comprises coating the first and second magnets with a plating material such as Tin, Nickel or Gold to prevent oxidation, and using a flat surface, cylindrical radius, or spherical radius as the contact surface between the first and second magnets.

The above and other features of the invention, including various novel details of construction and combinations of parts, will now be more particularly described with reference to the accompanying drawings and pointed out in the claims. It will be understood that the particular device embodying the invention is shown by way of illustration only and not as a limitation of the invention. The principles and features of this invention may be employed in various and numerous embodiments without departing from the scope of the invention.

BRIEF DESCRIPTION OF THE DRAWINGS

These and other features, aspects, and advantages of the apparatus and methods of the present invention will become better understood with regard to the following description, appended claims, and accompanying drawings where:

DETAILED DESCRIPTION OF THE INVENTION

Although this invention may be applicable to various electrical and circuitry systems, it has been found particularly useful in the environment of security and alarm systems for commercial and residential structures, and in particular, to windows, doors, sliding doors and the like. Therefore, without limiting the applicability of the invention to the above, the invention will be described in such environment.

Figure 1:
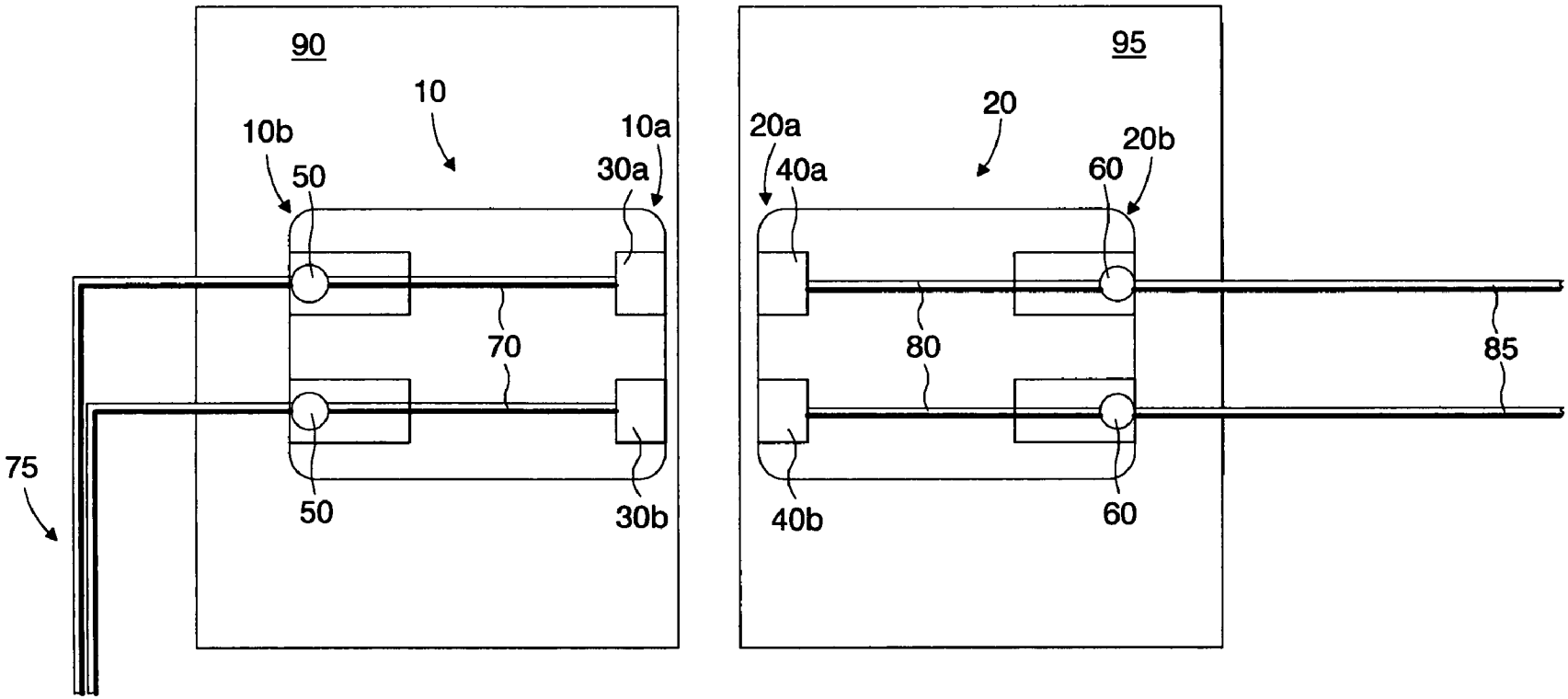
FIG. 1 shows two pull-a-part magnetic members using magnets that conduct electricity and complete the circuit of an alarm loop.

With reference now to the drawing, the components of the present invention will be described. FIG. 1 shows a first magnetic member 10 for attachment to a movable portion 90 and a second magnetic member 20 for attachment to a stationary portion 95. For example, windows, doors, sliding doors, and the like all have a movable portion 90 which moves or slides relative to the window frame, door frame, wall, floor or ceiling, which is the stationary portion 95 of the closure structure. Typically, a simple way of preventing unauthorized opening of such closures is to place a stick or other type of bar firmly between the movable portion 90 and the stationary portion 95 of the closure structure when the closure is in a closed position, thereby preventing the opening of the movable closure portion 90. In the present invention, the first magnetic member 10 is placed on the movable portion 90 and the second magnetic member 20 is placed on the stationary portion 95.

The first magnetic member 10 has a proximal end 10*a* and a distal end 10*b*. The first magnetic member 10 has first magnets 30*a* and 30*b* at the proximal end 10*a* of the first magnetic member 10. Similarly, the second magnetic member 20 has a proximal end 20*a* and a distal end 20*b*. The second magnetic member 20 has second magnets 40*a* and 40*b* on the proximal end 20*a* of the second magnetic member 20.

As shown in FIG. 1, two magnets are used for the first magnets 30*a* and 30*b*, and two magnets are used for the second magnets 40*a* and 40*b*. However, any number of magnets may be used from one to several, based on several factors. Depending on the size of the magnetic members 10, 20, size of the window or door, and the number of windows, doors, etc. that need to be secured, more or less magnets may be used for the magnets 30*a*, 30*b*, 40*a* and 40*b*. In a preferred embodiment, two magnets 30*a*, 30*b* are used for the first magnetic member 10 and two magnets 40*a*, 40*b* are used for the second magnetic member 20, as shown in FIG. 1. Any type of magnets may be used as the first magnets 30*a*, 30*b* and second magnets 40*a*, 40*b*, such as exposed rare earth magnets.

The first magnets 30*a* and 30*b*, and second magnets 40 and 40*b*, each have an N pole and S pole. The first magnets 30*a* and 30*b* are situated in the magnetic member 10 such that either the N pole of the magnets 30*a* and 30*b* faces the proximal end 10*a* and the S pole of the magnets 30*a* and 30*b* faces the distal end 10*b*, or vice versa. Similarly, the second magnets 40*a* and 40*b* are situated in the magnetic member 20 such that either the N pole of the magnets 40*a* and 40*b* faces the proximal end 20*a* and the S pole of the magnets 40*a* and 40*b* faces the distal end 20*b*, or vice versa. Further, the magnets 30*a*, 30*b*, 40*a* and 40*b* are situated such that the polarity of the first magnets 30*a* and 30*b* facing the proximal end 10*a* is opposite the polarity of the second magnets 40*a* and 40*b* facing the proximal end 20*a*.

Therefore, the magnetic polarity of the first magnets 30*a* and 30*b* at a proximal end 10*a* of the first magnetic member 10 will be opposite that of the magnetic polarity of the second magnets 40*a* and 40*b* at a proximal end 20*a* of the second magnetic member 20. Thus, if the first magnets 30*a* and 30*b* are placed in the magnetic member 10 so that the N pole faces the proximal end 10*a* and the S pole faces the distal end 10*b*, then the second magnets 40*a* and 40*b* are placed in the second magnetic member 20 so that the S pole faces the proximal end 20*a* and the N pole faces the distal end 20*b*. Similarly, if the first magnets 30*a* and 30*b* are placed in the magnetic member 10 so that the S pole faces the proximal end 10*a* and the N pole faces the distal end 10*b*, then the second magnets 40*a* and 40*b* are placed in the second magnetic member 20 so that the N pole faces the proximal end 20*a* and the S pole faces the distal end 20*b*.

The point is that the polarities of the magnets are opposite at the proximal ends 10*a* and 20*a* so that the two magnetic members 10, 20 attract. Thus, the magnetic members 10 and 20 will always attract due to the magnetic force between the ends of the magnets, allowing electricity to be conducted through the magnets 30*a*, 30*b*, 40*a* and 40*b* of the magnetic members 10, 20, respectively. The magnetic force between the magnets will keep the first magnetic member 10 attached to the second magnetic member 20.

Electrical connections 70 run from the first magnets 30*a* and 30*b* to terminals 50 at a distal end 10*b* of the first magnetic member 10. The electrical connections 70 may comprise a wire or a piece of metal such as a spring. Wires 75 then run from the terminals 50 back to an alarm panel (not shown) or RF transmitter, which is usually installed on a wall in a secure area of a house or commercial structure where the owner or operator can control it.

Similarly, electrical connections 80 run from the second magnets 40*a* and 40*b* to terminals 60 at a distal end of the second magnetic member 20. The electrical connections 80 may comprise a wire or a piece of metal such as a spring. Wires 85 can then extend from the terminals 60 to the terminals of another magnetic member similar to magnetic member 10, thus extending the security coverage to another door, window or wall. Thus, the wires 75 extending from the first magnetic member 10 that extend to the alarm panel or RF transmitter, and the wires 85 extending from the second magnetic member 20 to another magnetic member create an alarm loop. At the end of this alarm loop, an end of line resistor or a shorting wire can be used to close off the alarm loop. This alarm loop may be limited to one door or window, or may extend to several doors and/or windows, creating a larger alarm loop and broader coverage of the residential or commercial structure.

An alarm mechanism (not shown) is provided of standard design and may be any type of alarm mechanism such as a bell, buzzer or electronic alarm capable of making a noise or transmitting an alarm to a central station in response to an electrical signal. Since such alarm devices are readily available and well known in the art, the mechanism of the alarm will not be further discussed.

If only one magnet is used in the magnetic member 10 and one magnet used in the magnetic member 20, instead of the two as shown in FIG. 1, then the wires 85 run back to the alarm panel or RF transmitter similar to the wires 75.

Figure 2A:
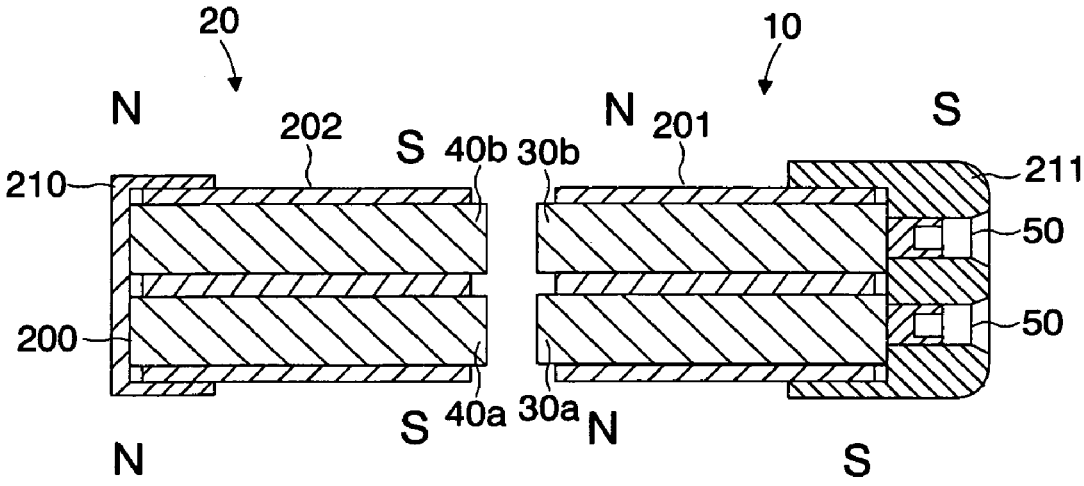
FIG. 2*a* shows two pull-a-part magnetic members using two magnets each enclosed in a housing when placed apart.
Figure 2B:
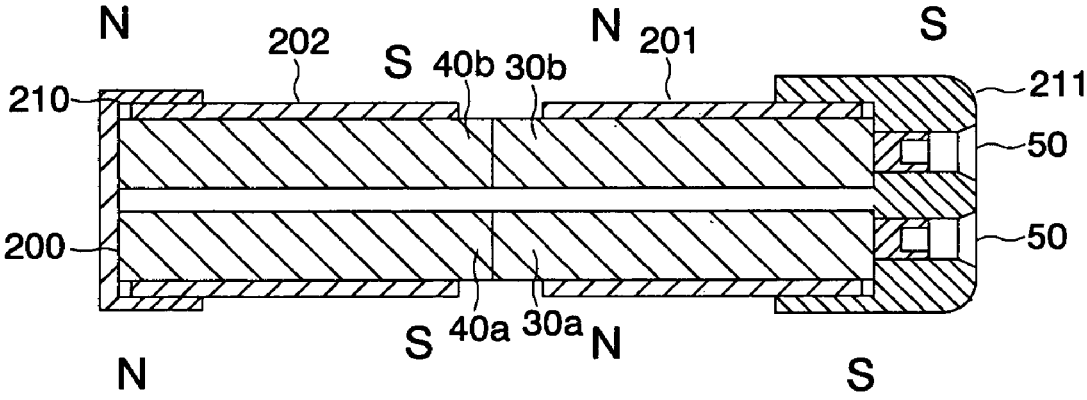
FIG. 2*b* shows two pull-a-part magnetic members using two magnets each enclosed in a housing when the magnetic forces cause the magnets to connect.

An example of a specific embodiment used in the end of the line of the alarm loop is shown in FIGS. 2*a* and 2*b*. FIG. 2*a* shows the magnetic members in an unconnected state. This assembly consists of four magnets oriented with their magnetic fields as shown. The magnetic member 10 has magnets 30*a* and 30*b* with an N pole at a proximal end 10*a* and an S pole at a distal end 10*b*. The magnetic member 20 has magnets 40*a* and 40*b* with an S pole at a proximal end 20*a* and an N pole at a distal end 20*b*. The N and S poles can be reversed. The magnets 30*a* and 30*b* are captured in a housing 201, and the magnets 40*a* and 40*b* are captured in a housing 202. The housings 201 and 202 are preferably but not limited to a plastic housing.

The spacing of the magnets is determined by the nominal wall thickness of the plastic housings 201 and 202, which is around 0.060". If the magnetic members 10 and 20 are the last of the alarm loop, then a shorting plate 200 is added to the distal end 20*b* of the magnetic member 20 to provide mechanical and electrical connections. An end cap 210 can be used to protect this connection. The magnetic member 10 has two terminal blocks 50 mechanically and electrically connected to each magnet 30*a* and 30*b* at the distal end 10*b*. An end cap 211 is required on the distal end 10*b* to provide strain relief and protection of the terminals 50. These terminals 50 can be connected to a pair of wires, which can be connected to an alarm system (not shown). Arrays of these assemblies can also be used in parallel, as explained above.

FIG. 2*b* shows the magnets 30*a* and 30*b* connected with magnets 40*a* and 40*b*, respectively. The N pole of the magnets 30*a* and 30*b* is attracted to the S pole of the magnets 40*a* and 40*b*, and the contact pressure is provided by the magnetic attraction between the north and south poles of the magnets.

Figure 3A:
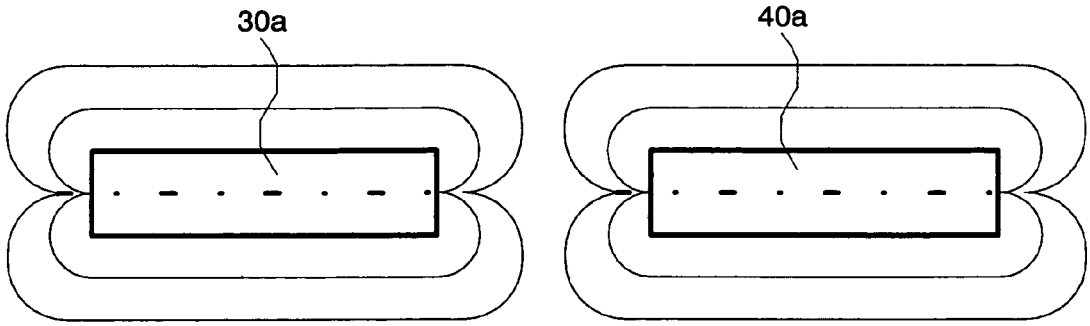
FIG. 3*a* shows the magnetic fields of the magnets when placed apart.
Figure 3B:
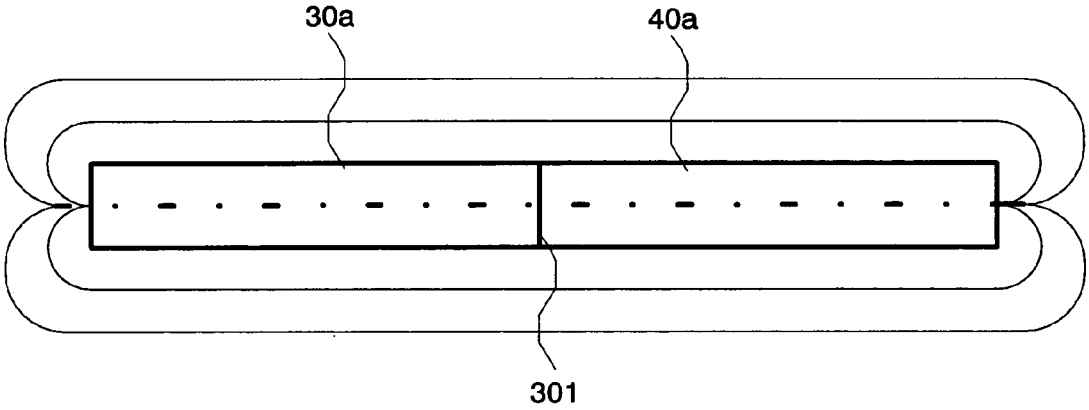
FIG. 3*b* shows the magnetic fields of the magnets when connected.

FIGS. 3*a* and 3*b* show the magnetic field of one of the two magnets pairs. As seen in FIG. 3*a*, the south pole of magnet 30*a* will attract the north pole of the magnet 40*a* when the magnets are placed in proximity. Thus, the north and south poles will attract each other and make contact at the contact point 301 when the magnets are placed in proximity, resulting in the magnetic field as shown in FIG. 3*b*.

The magnet material, size and shape are determined by the desired pull apart force and contact pressure, which is required to create a good electrical connection. The magnetic material could be AlNiCO (Aluminum Nickel Cobalt), NeBFe (Neodymium Boron Iron), Samarium Cobalt or Ceramic. The magnets 30*a*, 30*b*, 40*a* and 40*b* will need to be coated with a plating material such as Tin, Nickel or Gold to prevent oxidation from interfering with the electrical connection.

Figure 4:
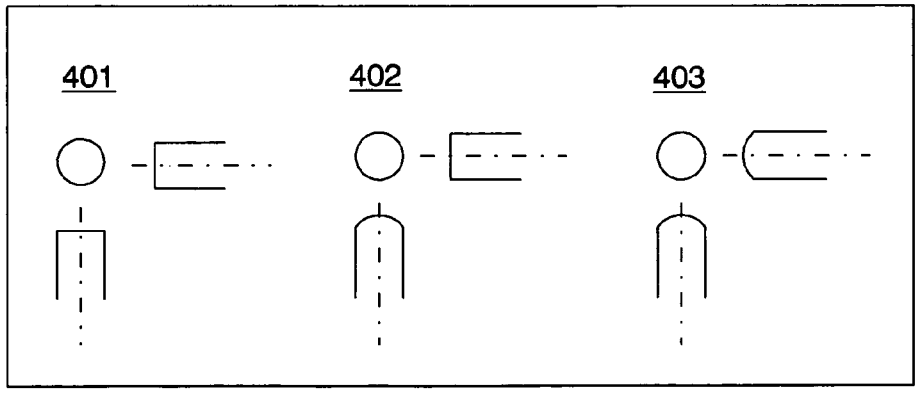
FIG. 4 shows different contact surfaces of the magnets.

As seen in FIG. 4, the contact surface between the magnets 30*a*, 30*b* and magnets 40*a*, 40*b* can be either a flat surface 401, a cylindrical radius 402 to provide line contact, or a spherical radius 403 to provide point contact at the contact point 301 (FIG. 3). A flat surface 401 is preferred from a manufacturing point of view. The cylindrical 402 and spherical 403 radiuses are preferred as the moveable contact surface will provide a wiping action and the smaller surface area will provide a higher contact pressure. The geometry of the contact between the magnets is important to provide a wiping action and the contact pressure between the magnets is also important.

Now, operation of the present invention in an illustrative embodiment will be described with references to the Figure and components described above.

A first magnetic member 10 is placed on the movable portion 90 and the second magnetic member 20 is placed on the stationary portion 95. The movable portion 90 can be a door or a window. The stationary portion 95 can be a wall, door frame, window frame, roof or ceiling. When the door or window (movable portion) is closed or shut, the movable portion 100 comes toward the stationary portion 200 so that the first magnets 30*a* and 30*b* of the first magnetic member 10 come directly into contact with the second magnets 40*a* and 40*b* of the second magnetic member 20.

The magnetic members 10 and 20 can be installed on the movable portion 90 and stationary portion 95, respectively, by attaching the housing 201, 202 onto the movable portion 90 and stationary portion 95, respectively. Thus, once the movable portion 90 and stationary portion 95 are brought together, the magnetic attraction between the magnets 30*a*, 30*b* and 40*a*, 40*b*, respectively, will connect the magnets. Alternatively, the housing 201, 202 can be left hanging on the wires 75, 85 so that once the door or window is shut, the magnetic members 10 and 20 are manually connected by a user and will stay in place and connected due to the magnetic attraction between the magnets.

Since the first magnets 30*a* and 30*b* are of opposite polarity than the second magnets 40*a* and 40*b*, they attract, and thus allow electricity to flow through the magnets 30*a*, 30*b*, 40*a* and 40*b* when the magnets are in direct contact with each other. Thus, electricity can be conducted from the wires 75 of the first magnetic member 10, through the first magnets 30*a*, 30*b*, through to the second magnets 40*a*, 40*b*, and then through the wires 85 of the second magnetic member 20. As a result, the first magnets 30*a*, 30*b* and second magnets 40*a*, 40*b* allow an alarm circuit to be completed through the use of magnets. A component or device of an alarm system (not shown) can turn on the alarm loop, thus allowing the electricity to flow through the wires when the door or window is closed, and activate the alarm system.

When the movable portion 90 is opened or moved away from the stationary portion 95, this pulls the first magnets 30*a* and 30*b* away from the second magnets 40*a* and 40*b*, respectively, thus opening the circuit and stopping the flow of electricity from the first magnetic member 10 to the second magnetic member 20. This causes an alarm mechanism (not shown) to trigger, such as a bell, buzzer or electronic alarm capable of making a loud noise or transmitting an alarm to a central station in response to an electrical signal. Preferably, the alarm mechanism keeps ringing until a code is entered into the alarm panel (not shown) to disarm the security system.

The present invention provides several advantages that solves the problems with prior art methods. In the prior art, standard pull-a-part contacts used spring loaded pin connectors to keep the contacts closed. In these devices, the pins could fall out and get lost, the pins could be corroded, and the springs that capture the pins could become weak and cause the contacts to open, causing false alarms.

In the present invention, magnets are used instead of springs and pins, so that the magnetic members are easily closed without having to mate up pins and holes. The magnets are plated with the right metallic coating, thus eliminating any oxidation or corrosion/oxidation. The magnets are preferably coated with a plating material such as Tin, Nickel or Gold to prevent oxidation. The magnetic members 10 and 20 are primarily made of plastic, with recesses to accommodate the magnets 30*a*, 30*b*, 40*a* and 40*b*. The terminals easily capture the wires during installation of the alarm system. These terminals may be screw terminals, or "snap down" terminals that would not need a screwdriver, making the device easier to install.

The present invention is small and easily installed on any door or window. The magnetic members can be made of plastic, which could be of a clear color, glass color, or any color to make it inconspicuous when installed on a door or window. Thus, a burglar may not be able to see it when attempting to break open a door or window in the premises. Moreover, should the device be removed from its armed position between the movable and stationary portions of the closure structure without first disarming the alarm, the magnets would separate causing the alarm to trigger immediately.

As can be seen from the above, the present invention is a simple yet very effective security device for closures and the like having at least one movable portion. The device is, in its illustrated and preferred form, entirely self-contained, is easily placed into position and armed, and is readily maintained in such a position in an inactive mode for extended periods of time without having to replace any power sources. Moreover, this particular security device is able to alert the owners of a residence or other premises to the intrusion of a burglar either by unauthorized removal of the device or by the unauthorized opening of the closure.

Finally, because of the simplicity of the device, it is easily and inexpensively manufactured thus providing a simple, inexpensive, yet effective security device which is readily affordable by the majority of people.

While the present invention envisions one magnetic member being connected for movement and the other contact member being connected for stationary disposition, the above described and illustrated arrangement is a particularly desired embodiment, although other arrangements of contact elements are envisioned for use with the present invention. As described above, one or both magnetic members can be secured on a wall or window. Alternatively, one or both magnetic members can be free to hang or freely move around, and depend only on the magnetic attraction to keep the magnets connected.

There are several other uses of the invention not limited by the illustrative description and embodiment as described above. The invention may also be applicable to other electronic systems and similar circuitry where magnets are used for the conduction of electricity.

While there has been shown and described what is considered to be illustrative embodiments of the invention, it will, of course, be understood that various modifications and changes in form or detail could readily be made without departing from the spirit of the invention. It is therefore intended that the invention be not limited to the exact forms described and illustrated, but should be constructed to cover all modifications that may fall within the scope of the appended claims.

What is claimed is:

1. A security device for residential and/or commercial use, said device comprising:

a first magnetic member having a first magnet with a north pole at a proximal end of said first magnetic member and a south pole at a distal end of said first magnetic member;

a second magnetic member having a second magnet with a south pole at a proximal end of said second magnetic member and a north pole at a distal end of said second magnetic member;

wherein contact between said first magnet and second magnet at said proximal ends of said first and second magnetic members completes an electrical circuit, wherein a magnetic force between said first and second magnets holds said first and second magnets in contact, and said electrical circuit is broken when a force sufficient to overcome said magnetic force is applied to separate said first and second magnets; and wherein said first and second magnetic members each comprise a plastic housing with recesses and said first and second magnets are situated inside said respective recesses.

2. The security device for residential and/or commercial use of claim 1, wherein said first magnetic member is placed on a movable portion of a closure structure and said second magnetic member is placed on a stationary portion of said closure structure.

3. The security device for residential and/or commercial use of claim 2, wherein said movable portion is a door and said stationary portion is a door frame.

4. The security device for residential and/or commercial use of claim 2, wherein said movable portion is a window and said stationary portion is a window frame.

5. The security device for residential and/or commercial use of claim 1, wherein the first magnetic member further comprises:

a third magnet with a north pole at said proximal end of said first magnetic member and a south pole at said distal end of said first magnetic member; and wherein the second magnetic member further comprises:

a fourth magnet with a south pole at said proximal end of said second magnetic member and a north pole at said distal end of said second magnetic member.

6. The security device for residential and/or commercial use of claim 1, wherein when said electrical circuit is broken off, an alarm is triggered.

7. The security device for residential and/or commercial use of claim 1, further comprising electrical connections from said first magnet to terminals located on said first magnetic member, and from said second magnet to terminals located on said second magnetic member.

8. The security device for residential and/or commercial use of claim 7, wherein said electrical connections comprise wires or springs.

9. The security device for residential and/or commercial use of claim 7, further comprising wires that run from the terminals of said firs magnetic member back to an alarm system.

10. The security device for residential and/or commercial use of claim 7, further comprising wires that run from the terminals of said second magnetic member to an end of line resistor to end an alarm loop.

11. The security device for residential and/or commercial use of claim 7, further comprising wires that run from the terminals of said second magnetic member to terminals of a third magnetic member similar to said first magnetic member, extending an alarm loop.

12. The security device for residential and/or commercial use of claim 1, further comprising end caps provided at said distal ends of said first and second magnetic members.

13. The security device for residential and/or commercial use of claim 1, wherein the magnets are made of a magnetic material selected from a group consisting of Aluminum Nickel Cobalt, Neodymium Boron Iron, Samarium Cobalt and Ceramic.

14. The security device for residential and/or commercial use of claim 1, wherein said first and second magnets are coated with a plating material such as Tin, Nickel or Gold to prevent oxidation.

15. The security device for residential and/or commercial use of claim 1, wherein a contact surface between the first and second magnets is selected from a group consisting of a flat surface, a cylindrical radius and spherical radius.

16. A method of installing a residential and/or commercial use, said method comprising the steps of:

attaching a first magnetic member having a first magnet with a north pole at a proximal end of said first magnetic member and a south pole at a distal end of said first magnetic member, with a second magnetic member having a second magnet with a south pole at a proximal end of said second magnetic member and a north pole at a distal end of said second magnetic member, the first magnet and the second magnet being situated in recesses of the respective first and second magnetic members, each of the first and second magnetic members being comprised of a plastic housing;

completing an electrical circuit by making contact between said first magnet and said second magnet; and holding the first and second magnets in contact with each other by a magnetic force between the first and second magnets.

17. The method of installing a residential and/or commercial security device of claim 16, further comprising disconnecting said electrical circuit by separating said first and second magnets by applying a force sufficient to overcome the magnetic force.

18. The method of installing a residential and/or commercial security device of claim 17, further comprising triggering an alarm by disconnect said electrical circuit.

19. The method of installing a residential and/or commercial security device of claim 16, further comprising forming an alarm loop by running an electrical connection from said first magnet to terminals on said first magnetic member, and through wires from said terminals to an alarm system.

20. The method of installing a residential and/or commercial security device of claim 19, further comprising forming an alarm loop by running an electrical connection from said second magnet to terminals on said second magnetic member, and through wires from said terminals to an end of line resistor to end the alarm loop.

21. The method of installing a residential and/or commercial security device of claim 19, further comprising forming an alarm loop by running an electrical connection from said second magnet through terminals on said second magnetic member, and through wires from said terminals on said second magnetic member to a third magnetic member similar to said first magnetic member, extending the alarm loop.

22. The method of installing a residential and/or commercial security device of claim 16, further comprising placing said first magnetic member on a movable portion of a closure structure and placing said second magnetic member on a stationary portion of said closure structure.

23. The method of installing a residential and/or commercial security device of claim 16, further comprising providing end caps at said ends of said first and second magnetic members.

24. The method of installing a residential and/or commercial security device of claim 16, further comprising using magnets made of Aluminum Nickel Cobalt, Neodymium Boron Iron, Samarium Cobalt or Ceramics as said first and second magnets.

25. The method of installing a residential and/or commercial security device of claim 16, further comprising coating said first and second magnets with a plating material such as Tin, Nickel or Gold to prevent oxidation.

26. The method of installing a residential and/or commercial security device of claim 16, further comprising using a flat surface, a cylindrical radius, or a spherical radius as the contact surface between first and second magnets.

* * * * *